US005104366A

United States Patent [19]

Bunch

[11] Patent Number: 5,104,366

[45] Date of Patent: Apr. 14, 1992

[54] APPARATUS FOR FOLDING A SERIES OF SEPARATED BUSINESS FORMS WITH THE TOP SHEET OF EACH FORM IN A COMMON ORIENTATION

[75] Inventor: Thomas E. Bunch, Phoenix, Ariz.

[73] Assignee: B. Bunch Company, Inc., Phoenix, Ariz.

[21] Appl. No.: 700,452

[22] Filed: May 15, 1991

[51] Int. Cl.[5] ..... B65H 45/107; B65H 45/20

[52] U.S. Cl. ..... 493/23; 493/357; 493/414

[58] Field of Search ..... 493/23, 24, 29, 357, 493/411, 412, 413, 414, 415; 225/100

[56] References Cited

U.S. PATENT DOCUMENTS

| | | | |
|---|---|---|---|
| 4,522,619 | 6/1985 | Bunch | 493/415 |
| 4,623,136 | 11/1986 | Bunch | 493/415 |
| 4,688,708 | 8/1987 | Irvine et al. | 493/22 |
| 5,014,971 | 5/1991 | Folsom | 493/414 |
| 5,024,644 | 6/1991 | Bunch | 493/357 |

*Primary Examiner*—William E. Terrell
*Attorney, Agent, or Firm*—Tod R. Nissle

[57] ABSTRACT

Apparatus for separating a series of business forms imprinted on a strip of continuous form stationery by cutting the strip of paper at selected points each representing the beginning of one of the reports and by then folding the cut strip of paper in zig-zag fashion into a stack. The apparatus folds the reports so that the top sheet in each stack is face up.

7 Claims, 9 Drawing Sheets

87A
9
FROM
FEED
ROLL
205
87
173
S6
88A
81
80
88
17
172
9
71a
S5
88B
TO
CHUTE
10
181
174
177
FROM SENSOR 175
178
245
246
176
FROM
SENSOR
46
23a
TO ROLLERS
200, 201

APPARATUS FOR FOLDING A SERIES OF SEPARATED BUSINESS FORMS WITH THE TOP SHEET OF EACH FORM IN A COMMON ORIENTATION

This invention relates to apparatus for separating a series of business reports or forms imprinted on a strip of continuous form stationery by cutting the strip of paper at selected points each representing the beginning of one of the reports and by then folding the cut strip of paper in zig-zag fashion into a stack.

More particularly, the invention concerns apparatus of the type described which cuts business reports from a strip of continuous form stationery and folds the reports in zig-zag fashion into a stack such that the top sheet in each stack is face up.

In business, it is a common practice to use one or more computers to input into a laser printer a series of reports. The laser printer sequentially prints the reports on a long strip of paper. The strip of paper is cut at points representing the first page of each report. Soon after the strip of paper is cut, it is folded in zig-zag fashion into a stack which contains the folded reports. The apparatus which cuts and folds the strip of paper from the laser printer is commonly called a job separator. The long strip of imprinted paper which is produced by the laser printer ordinarily has printing on only one side of the strip of paper. The reports imprinted on the strip of paper are often of varying length. For example, one report on the strip of paper may be three pages long, while the next report may be five pages long, and the next six pages long etc. As will be seen, when a report has an odd number of pages, the first folded sheet of the report will be in a different orientation than the first folded sheet of the report which immediately follows the first report.

After a stack of cut, folded reports is produced, each report is removed from the stack and passes underneath a sensor or reader which scans the information on the first (or last) page of the report. This information is used to determine the size of envelope the report is mailed in, additional information to included with the report, or other information. Consequently, if the first page of the report is folded down instead of up and therefore is not visible, then the sensor cannot read the data on the report. If a report produced by the job separator has the first sheet folded down, then the report can be manually or otherwise refolded so that the sensor can scan the necessary information on the first page of the report. Such a refolding procedure is cumbersome and significantly slows down the mailing or other final disposition of the cut reports.

Accordingly, it would be highly desirable to provide improved job separation apparatus which would cut a strip of imprinted continuous form stationery into separate reports imprinted on the stationary and which would fold the separated report into a stack such that the first page of paper in each report was in the same orientation, so that the printed side of the first page of the report could be viewed by an optical scanner or other sensor.

Therefore, it is a principal object of the invention to provide improved apparatus for separating reports from a strip of continuous form stationery and for folding the separated reports in zig-zag fashion into a stack.

A further object of the invention is to provide improved job separation apparatus which separates reports which are printed on one size of a strip of continuous form stationery and which then folds the separated reports into stacks such that the first (or last) sheet in each report is in a common "face-up" or "face-down" orientation.

These and other, further and more specific objects and advantages of the invention will be apparent to those skilled in the art from the following detailed description thereof, taken in conjunction with the drawings, in which.

Briefly, in accordance with my invention, I provide an improved apparatus for producing continuous form stationery by folding a strip of paper along transverse lines of weakening formed therein while the strip of paper moves along a path of travel through the apparatus. The strip of paper has front and back surfaces. The apparatus includes a frame, oscillating guide means mounted on the frame for alternately distributing successive ones of said lines of weakening in the strip of paper in substantially opposite directions; dispensing means for feeding the strip of paper into the guide means at a predetermined velocity; folding means carried on said frame and operatively associated with the oscillating guide means for urging the strip of paper distributed by the guide means into a folded condition, the folding means normally receiving and folding one of the lines of weakening each time the guide means moves through one oscillation; gear train means for transmitting motive power to actuate the oscillating guide means and the folding means; a drive shaft for transmitting motive power to the gear train means actuating the oscillating guide means and folding means, the drive shaft rotating at a first normal speed of rotation with respect to the velocity of the strip of paper; means for transmitting motive power to the dispensing means; power means to drive the means for transmitting motive power to the dispensing means. The guide means, dispensing means and folding means normally move in synchronous relationship during the operation of the apparatus. The improvement comprises means for, before a selected transverse lineation on the strip of paper is dispensed by the guide means and received by the folding means, completely severing the strip of paper along the selected transverse lineation to form a pair of opposing cut edges, the pair including a trailing cut edge, and a leading cut edge distributed by the guide means subsequent to the trailing edge; before the leading cut edge is dispensed by the guide means and received by the folding means, temporarily increasing with respect to the velocity of the strip of paper the speed of rotation of the drive shaft from the first normal speed of rotation to a second speed of rotation; and, decreasing the speed of rotation of the drive shaft from the temporary second speed of rotation back to the first normal speed of rotation after the drive shaft has rotated at the second speed of rotation for a selected period of time. The temporary second speed of rotation advances the guide means through about oscillation with respect to said strip of paper before the speed of rotation is returned from the temporary second speed of rotation to the normal speed of rotation such that the orientation of the surfaces on the folded length of the strip of paper including the leading cut edge correspond to the orientation of the surfaces on the folded length of the strip of paper including the trailing cut edge.

Figure 1:
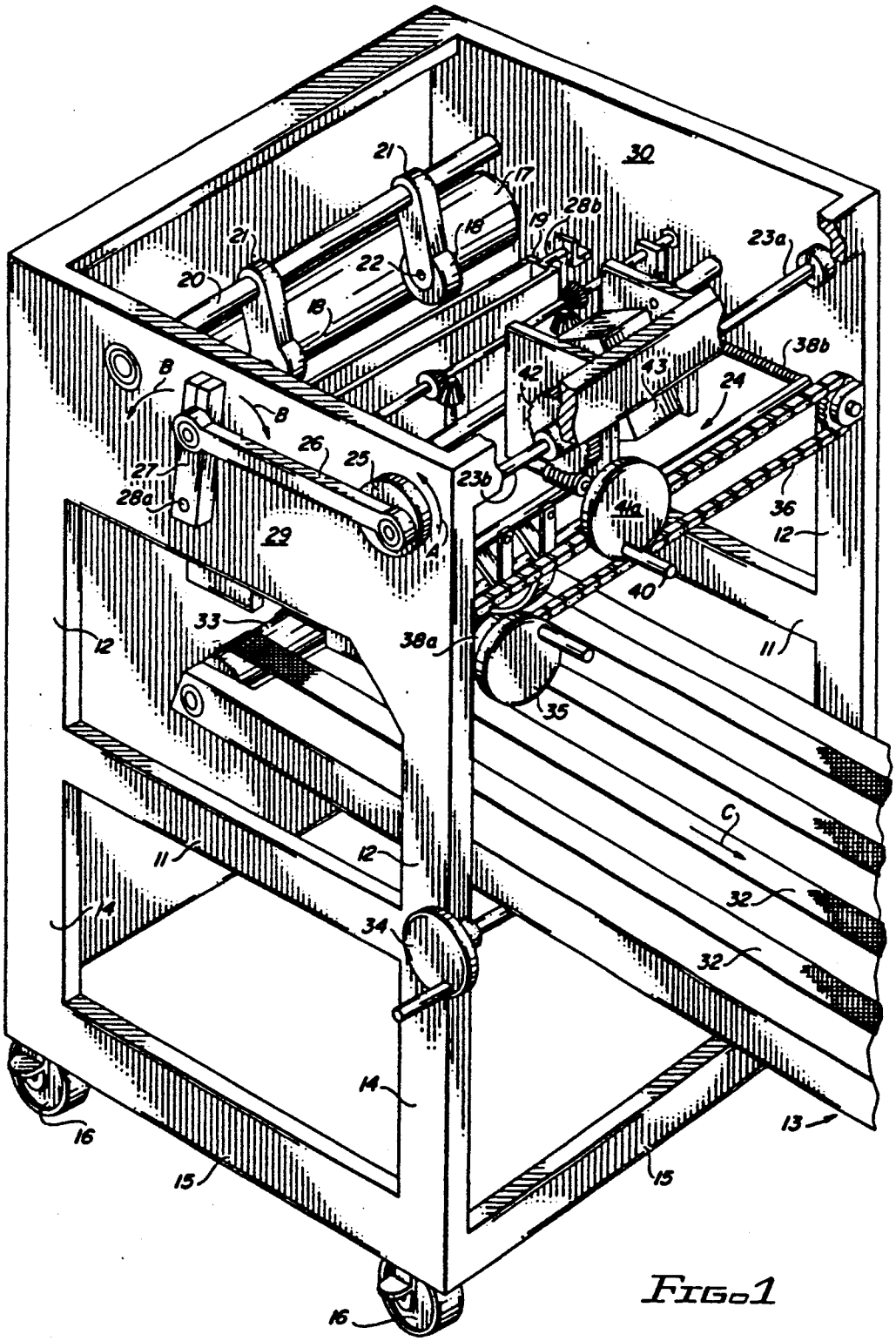
FIG. 1 is a perspective view of a spiral paper folding machine which can be utilized in the practice of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 is a perspective view showing the general arrangement of the elements. A frame consisting of horizontal members 11 and vertical members 12 supports the conveyor table 13 and various paper folding mechanisms which will be subsequently described. If desired, the frame 11–12 may be further provided with suitable support legs 14 and associated horizontal members 15 mounted on casters 16 to raise the entire apparatus to a convenient working height and to provide for moving the machine within a work area.

A continuous strip of paper or other material is drawn by dispensing roller 17 beneath roller guides 18 and axle 71*a* (not visible in FIG. 1) journalled for rotation in panels 29 and 30. The axle is rotated by the gear train of the apparatus. Roller guides 18 are secured to rod 20 by sleeves 21 provided with axles 22.

A pair of drive shafts 23*a* and 23*b* are integrated with the differential mechanism which is generally indicated by reference character 24. Shaft 23*b* rotates gear 25 in the direction of arrow A causing link 26 to reciprocate arm 27 in the directions of arrows B. Arm 27 is fixedly secured to shaft 28*a* which is attached to chute 19 and journalled for rotation in panel 29. An identical shaft 28*b* is affixed to the opposite side of chute 19 and is journalled for rotation in panel 30.

Transverse lines of weakening along material entering chute 19 are distributed in substantially opposite directions as chute 19 oscillates and, as later described, the material is compressed and folded by "beaters" and "spirals" (not visible in FIG. 1). Continuous moving belts 32 carried by roller 33 carry the folded paper away from the folding mechanisms in the direction of arrow C. The slope of conveyor table 13 is adjusted by turning handle 34.

Threaded shafts 38*a* and 38*b* each carry a sprocket 37 which engages continuous chain 36. By turning handle 35 shaft 38*a* is rotated causing the teeth of sprocket 37 to engage and turn continuous chain 36 so that sprocket 37 and shaft 38*b* horizontally adjusts the positions of the beaters, spirals and paper stops (not visible).

Differential mechanism 24 includes handle 40 for rotating shaft 41 which is provided with worm gear 41*a* engaging ring gear 42 fixedly attached to spider 43. As would be apparent to those skilled in the art, handle 40 may be turned while drive shafts 23*a* and 23*b* are rotated or are motionless so that the position of a particular point on shaft 23*b* may be rotated in relation to a point on shaft 23*b*. When handle 40 is turned, shaft 236 is advanced or retarded with respect to shaft 23*a*. When handle 40 is not used to adjust the relative position of shafts 23*a* and 23*b*, the differential functions as an idler, allowing each shaft to turn at identical rpm.

The spiral paper folding machine illustrated in FIGS. 1 to 4 herein corresponds in many respects to the machine described in U.S. Pat. No. 4,522,619. The general operation of spiral paper folding machines is well understood in the art. To facilitate, however, the understanding of how the particular conventional spiral folding machine of FIGS. 1 to 4 herein operates, like reference characters in FIGS. 1 to 4 herein and in U.S. Pat. No. 4,522,619 identify corresponding elements.

Figure 2:
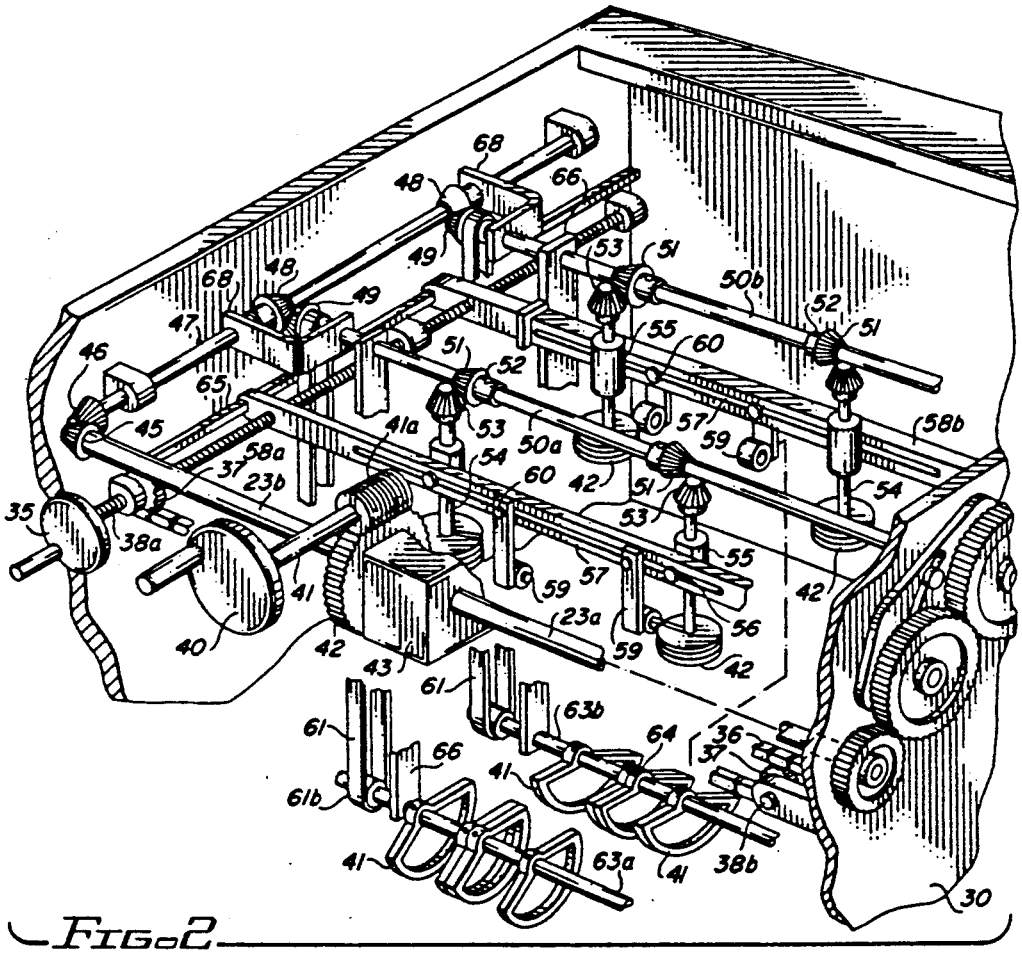
FIG. 2 is an enlarged partial perspective view of a portion of the spiral paper folding machine of FIG. 1 illustrating details of the paper folding machine and associated drive train.
Figure 3:
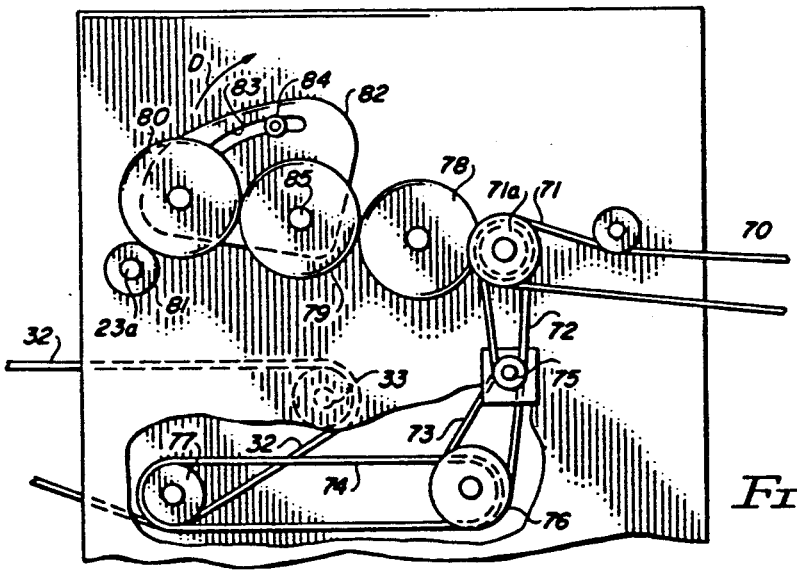
FIG. 3 is a schematic drawing of the right hand side of the paper folding machine of FIG. 1 illustrating the drive mechanism which activates the paper dispensing roller and further transmits motive power to that portion of the gear train activating the paper folding and distributing mechanisms.
Figure 4:
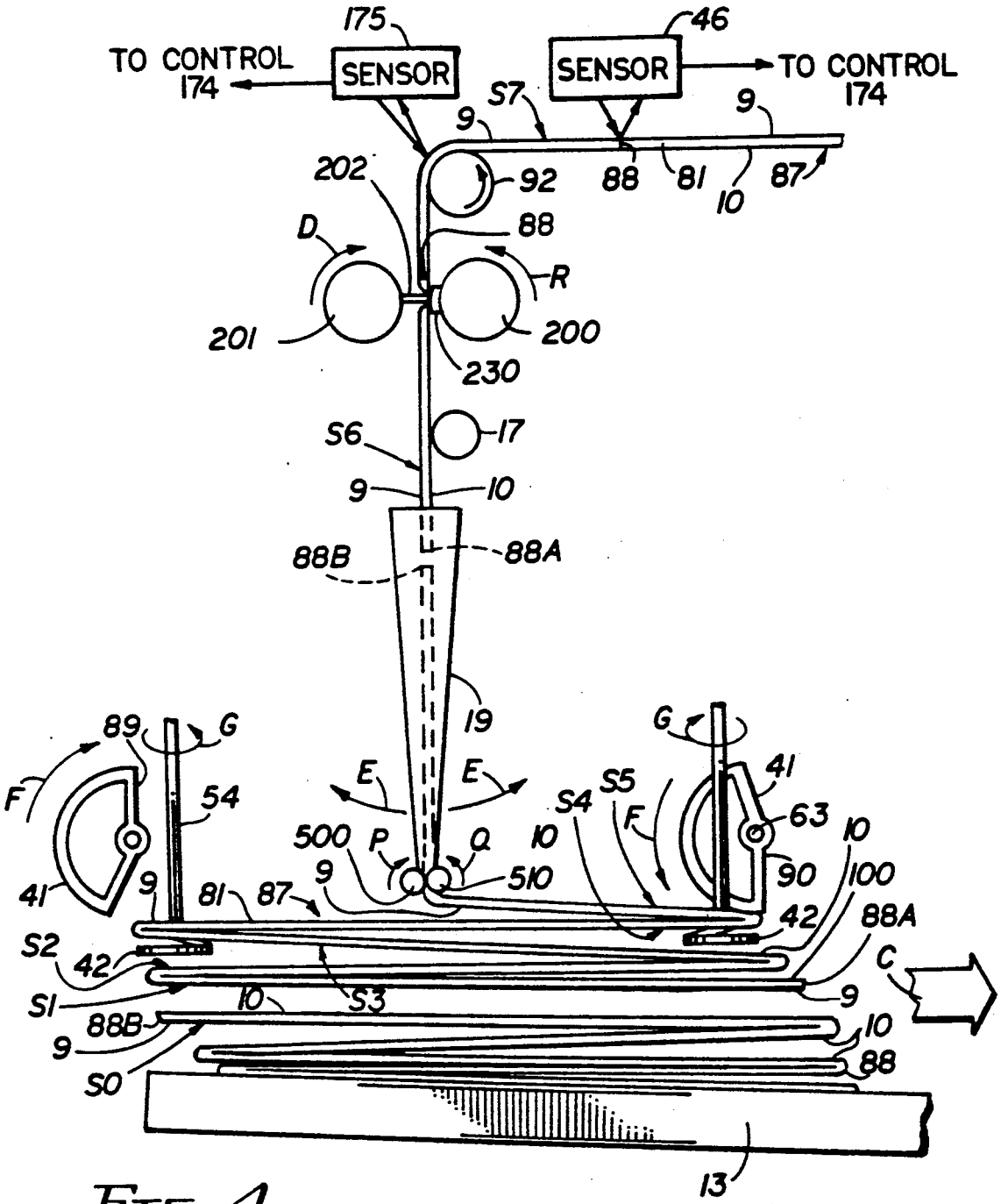
FIG. 4 is schematic view illustrating the relationship between the paper folding mechanisms of the machine of FIG. 1 and the apparatus utilized to cut the paper strip at selected points therealong and intermittently advance the chute through about one oscillation with respect to the strip of paper and the feed roller.

FIGS. 2–4 illustrate the interrelation of the beaters 41, spirals 42, chute 19 and gear train of the apparatus. As shown in FIG. 2, drive shaft 23*b* is provided with pinion gear 45 which drives gear 46 to rotate shaft 47 and bevel gears 48 mounted thereon. Gears 48 drive bevel gears 49 to rotate shafts 50 and gears 51 which are secured to shaft 50 by setscrews 52. Pinion gears 51 turn beveled gears 53 to rotate shafts 54 and spirals 42. Shafts 54 are journalled for rotation in sleeves 55 which are provided with set screws 56 for transversely adjusting the position of spirals 42 along slots 57 in support bars 58 Paper stops 59 are also fixedly adjustably attached to bars 58 by set screws 60.

When shafts 50 are rotated, continuous belts 61 mounted on rollers 61*a* and 61*b* affixed to rods 50 and 63 turn and simultaneously rotate shafts 61 on which beaters 41 are adjustably mounted. Set screws 64 permit beaters 41 to be positioned along shafts 63.

When threaded shafts 38*a* and 38*b* are rotated by turning handle 35, support bars are moved along rails 65 horizontally positioned on the interior of panels 29 and 30. Member 66*a* interconnects the left hand ends of shaft 51*a*, bar 58*a* and rod 63*a* so that when threaded rods 38*a* and 38*b* are rotated shaft 50*a*, bar 58*a* and rod 63*a* move in unison. A second member 66*a* (not visible) interconnects the right hand ends of shaft 50*b*, bar 58*b* and rod 63*b* so that when threaded rods 38*a* and 38*b* are rotated shaft 50*b*, bar 58*b* and rod 63*b* move in unison. A second member 66*b* (not visible) interconnects the right hand ends of shaft 50*b*, bar 58*b* and rod 63*b*. When the position of bars 58*a* and 58*b* are adjusted along threaded rods 38*a* and 38*b* gears 48 slide along rod 47.

L-shaped brackets 68 function to keep pinion gears 48 meshed with gears 49.

As shown in FIG. 3 belt 70 from power means (not shown) which drive the gear train actuates gear 71. Continuous belts 72, 73, and 74 transmit power to conveyor belts 32 of table 13 through pulley gear 75 and rollers 76, 77. Motive power from gear 71 is transmitted through sector gears 78, 79, and 80 to removable toothed gear 81. Gear 80 is attached to plate 82 having slot 83 formed therein and which is rotatably mounted on rod 85. In order to remove gear 81 from shaft 23*a*, gear 80 is upwardly lifted in the direction of arrow D by loosening set screw 84 in slot 83. Depending on the distance between successive lines of weakening in the paper being folded various sized gears 81 are used to rotate drive shaft 23*a*.

The schematic diagram in FIG. 4 illustrates the synchronous relationship of the chute 19, beaters 41 and spirals 42 as they respectively move in the directions indicated by arrows E, F and G. When lines of weakening formed in the strip of paper are distributed in opposite directions by the chute 19, beaters 41 and spirals 42 compress paper strip or material 87 to form folds 88. Ideally the beaters 41 strike the upper surface of material 87 one half to two inches behind the lines of weakening along which the paper is folded. The chute and beaters are synchronized such that when the chute is essentially at the midpoint of its oscillation arc, as shown in FIG. 4, the surfaces 89 and 90 of beaters 41 mounted on their respective shafts 63 are in the positions shown in FIG. 4. Similarly, when the chute 19 and beaters 41 are in the positions illustrated in FIG. 4 a given point on the periphery of each spirals 42 is in a particular position.

Figure 1A:
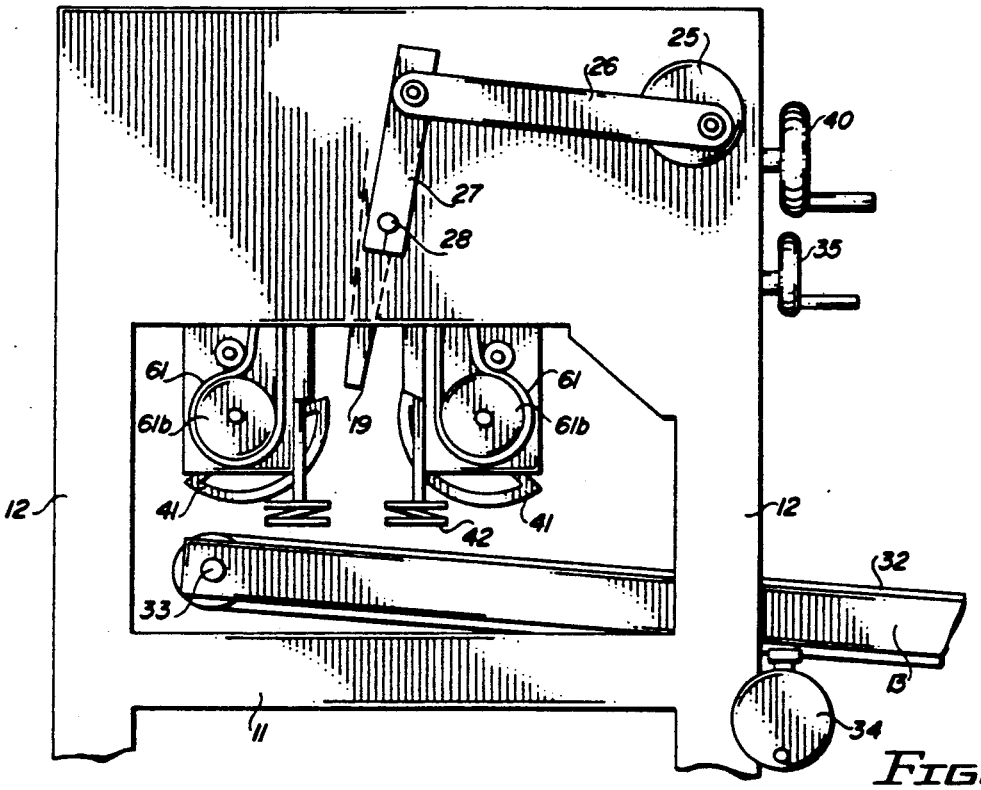
FIG. 1A is a left side elevational view of the spiral paper folding machine of FIG. 1.
Figure 6:
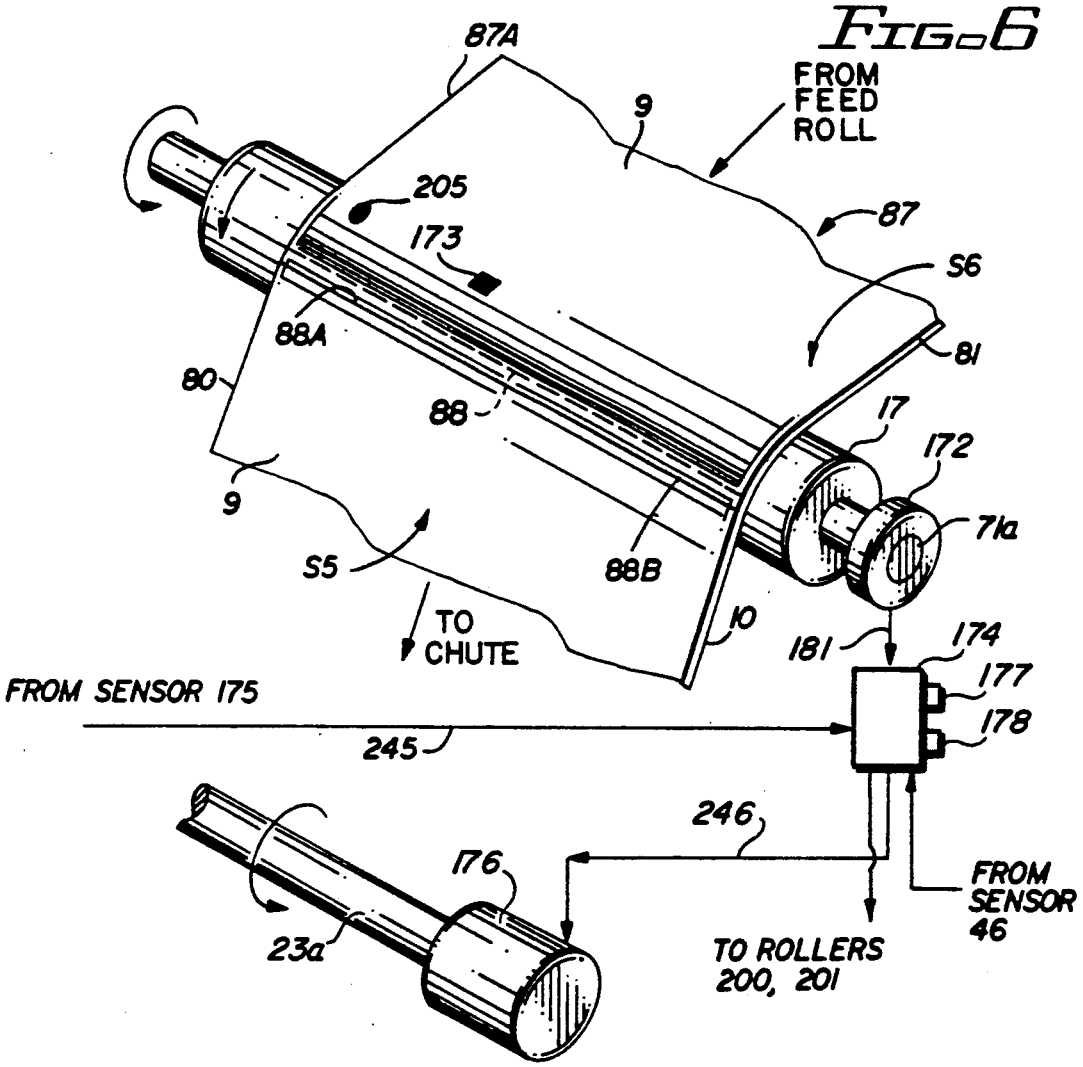
FIG. 6 is a schematic drawing illustrating apparatus for automatically advancing the chute through one oscillation with respect to the feed rollers and the strip of paper moving through the folding machine.

Knife edge or blade 202 is fixedly attached to roller 201. Anvil 230 is fixedly attached to roller 200. Roller 201 rotates in the direction of arrow D. Roller 200 rotates in the direction of arrow R, normally at the same speed as roller 201. Feed roller 92 dispenses paper intermediate rollers 201 and 200 and into chute 19. Rollers 500 and 510 rotate in the directions indicated by arrows P and Q and draw paper strip 87 therebetween to dispense paper from chute 19 as chute 19 oscillates in the directions indicated by arrows E. If rollers 500, 510 are not required to tension strip 87 such that strip 87 bursts in the chute 19, rollers 500 and 510 need not be included or mounted on the mouth of chute 19, in which case the mouth of chute 19 would have the appearance illustrated in FIG. 1A. Paper folded and dispensed by spirals 42 is moved in the direction of arrow C by conveyor table 13. Sensor 6 detects a line of weakening 88 or a mark or some other reference point on paper 87 which is moving by sensor 46. When sensor 46 detects a line of weakening or some other reference point on paper strip 87, it sends a signal to control 174 (FIG. 6). Control 174 periodically causes rollers 200 and 201 to partially sever strip 87 along a selected transverse lineation and causes rollers 500 and 510 to momentarily increase their speed of rotation to increase the tension of strip 87 and cause strip 87 to completely sever along the transverse lineation which was earlier partially severed by blade 202 and anvil 230.

Gear trains and motors for synchronously driving roller 92, rollers 201 and 200, chute 19, beaters 41, spirals 42, and rollers 500 and 510 are well known in the art, as are means for driving the belts on table 13, and are not described in detail herein.

Figure 5:
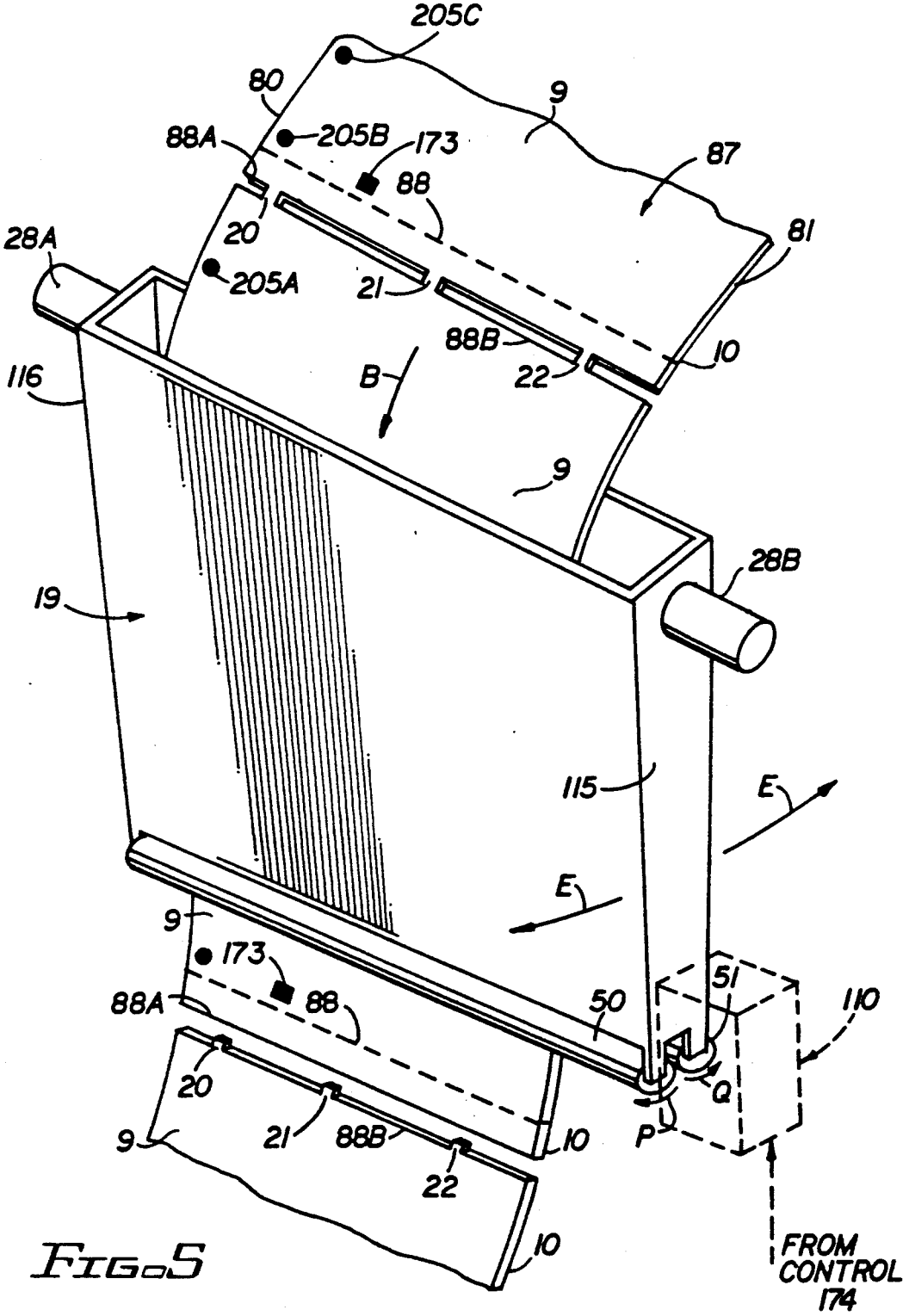
FIG. 5 is a perspective view further illustrating the chute shown in FIG. 4.

As shown in FIG. 5, the strip of paper 87 is presently preferably partially severed by knife or blade 202 along transverse lineations which extend from one edge 80 to the other opposed parallel edge 81 of strip 87 and which are parallel to and offset from transverse lines of weakening or perforation 88 formed at equally spaced intervals along paper strip 87. After strip 87 is cut along a transverse lineation by edge 202, small tabs 20 to 22 remain which function to hold opposing leading edge 88A and trailing edge 88B together. After tabs 20 to 22 pass into chute 29, the speed of rollers 500, 510 is momentarily increased from their normal running rotational speed. When the speed of rollers 500 and 510 is momentarily increased from their normal running rotational speed, the rollers 500 and 510 increase the tension pulling paper strip 87 in the direction of arrow B and cause tabs 20 to 22 to tear or break free from leading edge 88A and/or trailing edge 88B. If desired, knife edge 11 can completely sever strip 87 along transverse lineations so that it is not necessary to momentarily increase the speed of rollers 500 and 510 to completely sever the paper along transverse lineations, nor is it even necessary to utilize rollers 500 and 510 on chute 19.

In FIG. 2 the space between opposed leading edge 88A and trailing edge 88B is exaggerated for the sake of clarity. The space between 88A and 88B normally appears to the human eye to be a small cut line or slit. Similarly, the size of tabs 20 to 22 is larger than normal. The size and number of tabs 20 to 22 can vary as long as the tabs interconnect edges 88A and 88B until the tabs 20 to 22 enter the chute and as long as the increase in rotational speed of rollers 500 and 510 causes tabs 20 to 22 to separate from edges 88A and 88B when the tabs are in the chute.

Various means can be utilized to control rollers 200 and 201 such that the rollers or some other cutting means will only cut strip 87 along selected lineations. In one preferred embodiment rollers 200 and 201 normally rotate so that anvil 230 passes by strip 87 just before edge 202. When anvil 230 passes by strip 87 just prior to blade 202, the blade 202 never contacts the anvil 230 and strip 87 is not cut. When it is desired to cut strip 87 along a particular selected lineation, then roller 230 is temporarily retarded to permit blade 202 to "catch up" to anvil 230 such that blade 202 presses strip 87 against anvil 230 and cuts strip 87. As soon as blade 202 cuts strip 87, roller 200 is permitted to return to its normal speed of rotation so that anvil 230 again passes by strip 87 just prior to blade 202 and blade 202 does not contact anvil 230 and cut strip 87. Blade 202 and anvil 230 can be utilized to cut strip 87 at equal spacings along strip 87, or can be used, as shown in FIG. 4, to cut strip 87 at different spacings therealong. In FIG. 4, a length of paper five folds long has been cut from strip 87 and includes fold lengths S1 to S5. A length of paper equal to only one fold length, fold length S6, is being cut from strip 87 in FIG. 4. In FIG. 4, blade 202 is cutting the trailing edge of sheet S6.

The transverse lineation along which edge 202 partially severs the strip of paper 87 can correspond to a line of weakening 88 or can, in the manner shown in FIG. 5, be offset from a line of weakening 88. In practice, edge 202 usually makes a cut along a transverse lineation which is offset and spaced apart from a line of weakening 88 because operating rollers 200 and 201 to insure that a cut is made exactly on a line of weakening 88 can be difficult to accomplish on a consistent basis.

Control 174 activates roller 200, i.e., sends a signal to retard roller 200 so blade 202 will contact anvil 230 in the manner shown in FIG. 4, when control 174 receives a signal from sensor 46. Sensor 46 detects equally spaced reference marks or points as paper strip 87 moves past sensor 46 (FIG. 4). Each time sensor 46 detects a reference point, the paper between rollers 200 and 201 is ready to be partially severed along a selected transverse lineation. At the same time, just prior to the time, or after the time that control 174 retards roller 200 to partially sever strip 87, control 174 also momentarily increases the speed of rotation of rollers 500 and 510. Increasing the speed of rotation of rollers 500 and 510 increases the tension on the paper passing through chute 19 and causes the tabs 20 to 22 bridging a pair of opposed cut edges 88A, 88B to tear or separate so that the strip of paper is completely severed between edges 88A, 88B. In FIG. 5, the edge 88A which has just been dispensed from the rollers 500 and 510 at the mouth of the chute is completely severed from its opposing edge 88B.

Instead of using control 174, which in conventional fashion incorporates a microprocessor therein, roller 200 can be manually activated, i.e., retarded, using a switch or other means to activate roller 200.

Instead of periodically momentarily increasing the speed of rollers 500, 510, the rollers 500 and 510 can continuously be rotated at a speed which tends to pull paper from between rollers 200 and 201 through the chute at a rate which is slightly greater than the rate at which roller 92 feeds paper intermediate rollers 200 and 201. Continuously running rollers 500 and 510 at a rotational rate which pulls paper from between rollers 200 and 201 faster than the rate at which the paper is fed into the rollers 200 and 201 by roller 92 tensions the paper strip 87 and facilitates the complete severing of the strip 87 along a line of partial severing produced by rollers 200 and 201 and edge 202. When, however, the rollers 500 and 510 are continuously run in an "overdrive" condition, it is more difficult to ensure that a partially severed transverse lineation is pulled apart inside the chute and is not pulled apart after the transverse lineation leaves the rollers 200, 201 and before the partially severed lineation enters the chute 19. Accordingly, it is presently preferred that the rotational speed of each roller 500 and 510 be increased from a normal rotational speed only when a partially severed transverse lineation is in chute 19 and is ready to be completely severed. Rollers 500 and 510 typically are of equal diameter and each rotate at the same speed.

Any of a variety of prior art motors and/or gearing arrangements can be utilized to momentarily periodically increase the speed of rotation of both rollers 500 and 510. In particular, a stepper motor could be utilized in a manner similar to that described in the co-pending application Ser. No. 462,766, filed Jan. 10, 1989 for "SPIRAL PAPER FOLDING MACHINE WITH AUTOMATIC CHANGE GEAR ADJUSTMENT", and similar to that described herein to advance chute 19 through about one oscillation with respect to dispensing roller 17 and strip 87.

In FIG. 4, the position of sensor 46 is known, as is the distance from sensor 46 to rollers 200 and 201 and the spacing of lines of weakening 88 or other reference point along strip 87. When a reference point is identified by sensor 46, control 174 therefore knows the position of the closest line of weakening approaching rollers 200 and 01 and knows that if edge 202 is immediately used to partially sever strip 87, the cut made in strip 87 will, within a selected tolerance be a certain distance from a line of weakening 88. In an alternate embodiment of the invention, sensor 46 periodically detects reference marks which are on the first page of each of a plurality of reports which are sequentially printed on strip 87. Each time sensor 46 detects such a reference mark, it sends a signal to control 174. Control 174 then commands roller 200 to momentarily retard such that the strip 87 is cut between the last page of one report and the first page of the next report.

Rollers 500 and 510 can be positioned inside chute 19. Opposing belts or other means can be mounted on chute 19 to pull and tension partially severed paper 87 which is moving from rollers 200 and 201 to chute 19. Strip 87 can periodically be completely severed in chute 19 by rollers 200, 201 or by using any other desired means mounted on or operatively associated with chute 19.

In FIG. 4, rollers 200 and 201 presently preferably turn at a speed which causes edge 202 and anvil 230 to move at a speed generally equivalent to the speed of paper 87 moving intermediate rollers 200 and 201.

In order to intermittently increase the speed of rotation of rollers 500 and 510, a small motor 110 can be mounted on the lower portion of one side 115 of chute 19 in the manner indicated by dashed lines 110 in FIG. 5. Motor 110, the size of which is exaggerated in FIG. 5, oscillates with chute 19 in the directions indicated by arrows E. Motor 110 intermittently increases the speed of rollers 500 and 510 in order to tension paper passing through chute 19 to cause the paper to completely separate along partially cut lineations.

As noted, paper strip 87 is preferably cut by edge 202 along lineations offset from lines of weakening 88. The lineations also preferably precede lines of weakening 88 in the manner illustrated in FIG. 5 and the lineations are partially cut so that less tension is required to separate the paper along a partially cut lineation than is required to separate the paper along a line of weakening 88. As a result, even if tension generated by rollers 500 and 510 on paper in chute 19 is sufficient to separate paper 87 along a line of weakening, the paper 87 tends to completely sever along the partially cut lineation before it can separate along a line of weakening 88. The tension generated by rollers 500, 510 preferably, but not necessarily, is only sufficient to separate paper 87 along a partially cut lineation and not along a line of weakening 88. Each time the tension acting on paper 87 is increased by rollers 500 and 510 or some other means, there preferably is only a single partially cut lineation in the portion of the paper strip 87 which precedes and is moving toward rollers 500 and 510 and is tensioned by rollers 500 and 510. If there is more than one partially cut lineation in a portion or length of paper which is tensioned by rollers 500 and 501 to completely sever the paper 87, it is difficult to predict whether paper 87 will sever along each of or only one of the partially cut lineations.

In FIG. 6, sensor 175 is used to read a reference area 173 imprinted on the first sheet S6 of a report which is imprinted along surface 9 of strip 87. The reference area 173 indicates the number of sheets in the report and can include other information. The sensor 175 signals the number of sheets in the report to control 174. FIG. 6 shows the position of sheet S6 just before it enters chute 19 and is pulled apart in the manner illustrated in FIG. 4. Reference area 173 can, for example, comprise a bar code. In FIGS. 4 to 6 the front planar surface of strip 87 is indicated by reference character 9; the back planar surface of strip 87 is indicated by reference character 10. It is, for the sake of example, assumed that reports are imprinted on surface 9 and not on surface 10.

After control 174 receives from sensor 175 the number of pages indicated by reference area 173, control 174 determines if the number of pages is odd or even. If the number of pages in the report is even, control 174 knows that chute 19 does not have to be advanced one oscillation just before the first sheet of the report is distributed to insure that the last folded sheet of the report will be in the same orientation as the last folded sheet of the preceding report. When the number of pages in the report is odd, control 174 knows chute 19 must be advanced through an oscillation to insure that the last folded page of the next report is in the same orientation as the last folded page of the preceding report.

Two fold lengths or pages are in the same orientation when the surface 9 of each fold length faces in the same direction. In FIG. 4, the fold lengths comprised of sheets or pages S1 and S2 are not in the same orientation because surface 9 of sheet S1 faces down and in the opposite direction of surface 9 of sheet S2. Surface 9 of sheet S2 faces up. On the other hand, the fold lengths comprised of sheets S0 and S1 are in the same orientation because the surface 9 of sheet S0 faces in the same direction, down, as surface 9 of sheet S1. Sheet 50 is the last page of a report. Sheet S1 is the first page of a report. Sheet S5 is the last page of a report.

Reference area 173 on sheet S6 indicates that there are an odd number of pages in the report and that the total number of pages is one. The fact that there in only one page, S6, in the report explains why in FIG. 4 blade 202 is cutting the trailing edge of sheet S6. There is a reference area 173 on the first page of each report of "job" on strip 87. Accordingly, in FIG. 4, a reference area 173 is on the folded length comprised of sheet S1 and is on sheet S7, as well as sheet S6.

When sensor 175 informs control 174 that there is an odd number of pages in a report, control 174, as will be further described, sends a signal 246 to stepper motor 176 after the leading edge 88A has been completely separated from trailing edge 88B in the chute 19. In FIG. 6, stepper motor 176 is used to turn shaft 23 instead of the gear 81 shown in FIG. 3. In FIG. 6, gear 81 has been removed and is not, along with sector gears 78 to 80 of FIG. 3 utilized. Stepper motor 176 provides the motive power for the chute 19 and folding mechanisms. In FIG. 4, the leading edge 88A of sheet S6 has just been separated from the trailing edge 88B of sheet S5 in chute 19. This separation took place shortly after sensor 175 read reference area 173 and reported to control 174 that there was a single sheet, sheet S6, in the report. Consequently, after the leading edge 88A of sheet S6 is separated from the trailing edge 88B of sheet S5, control 174 sends a signal 246 to the stepper motor 176 which causes the speed of the chute to temporarily increase with respect to the speed of the feed roller 17 and the paper strip 87. This temporary increase in the speed of the chute advances the chute through about a distance equal to about one oscillation which respect to the paper strip 87 and feed roller 17. Advancing the chute through a distance equal to the distance of one oscillation or swing of the chute, causes the chute to distribute the next sheet, S6, "upside down" from the orientation that the sheet S6 would have been distributed in if the chute had not been advanced through a distance equal to about one oscillation.

When the chute 19 is advanced through a distance equal to one oscillation by stepper motor 176, this advancement of the chute needs to be completed before the leading edge 88A of the next sheet S6 is distributed by the chute. In FIG. 4, advancing the chute 19 from the position shown through a distance equal to about one oscillation causes the leading edge 88A of sheet S6 to be distributed to the spiral 42 and beater 41 shown in the right hand side of the drawing of FIG. 4 instead of to the spiral 42 and beater on the left hand side of the drawing of FIG. 4. So advancing the chute through a distance equal to one oscillation to distribute the first page of a report in the same orientation as the last page of the preceding report insures that the last folded page of a report having an odd number of pages will have the same orientation as the last folded page of the immediately preceding report. In FIG. 4, S0 and S5 are the last folded pages of two reports and each of the fold lengths comprised of sheets S0 and S5 has the same orientation. In the fold lengths comprised of sheets S5 and S1, the surface 10 of each fold length faces in the same upward direction. Just before sheet S1 was distributed by chute 19, chute 19 was advanced through one oscillation so that sheet S1 would be distributed in the same orientation as sheet S0. After sheet S6 is distributed into the folding mechanism the spirals 42 and beaters 41 in FIG. 4, the orientation of sheet S6 will be the same as that of sheets S0 and S5. Since sheet S6 is the only page in a report, sheet S6 comprises both the first and last pages of the report. As would be appreciated by those of skill in the art, the apparatus of the invention could also be operated to insure that the first, instead of the last, page of each report has an identical orientation. This is accomplished by using stepper motor 176 to periodically advance chute 19 through one oscillation so that the first page of each report distributed and folded immediately after a preceding report which has an odd number of pages is distributed by the chute 19 in the same orientation at the last page of said preceding report.

As noted above, control 174 commands stepper motor 176 to advance chute 19 only after paper strip 87 has been completely severed, either in chute 19 or before entering chute 19. Control 174 can determine when strip 87 is completely severed in FIG. 4 by using a sensor (not shown) mounted in the chute 19, by using data provided by sensor 46 along with the known velocity of strip 87 provided by sensor 172 to calculate when strip 87 will be burst in chute 19, or by using any other desired prior art apparatus. If chute 19 is advanced through one oscillation before strip 87 is completely severed, chute 19 would tend to tear strip 87 from the spirals and beaters and foul up the folding mechanisms.

When stepper motor 176 advances chute 19 through about one oscillation, it is preferred that the speed of rotation of rollers 500 and 510 also be proportionately increased so that sufficient paper is distributed by chute 19 to prevent chute 19 from pulling paper free from spirals 42 or beaters 41. In the presently preferred embodiment of the invention described below, causing the stepper motor to rotate through 90 degrees causes shaft 23 to rotate one-half revolution. When shaft 23 (which includes sections **23*a* and 23*b* in FIG. 1) rotates through one-half revolution, then the chute 19 is moved through a distance equal to the distance in one oscillation or swing. Chute 19 moves through one oscillation when it moves from one of its furthest points of travel through an arc to the other of its furthest points of travel. The advancement of chute 19 through one oscillation can be initiated when chute 19** is at any desired position in its cycle of travel.

Sensor 172 is mounted on and operatively associated with shaft 71*a*. Sensor 172 generates 600 primary pulses or electromagnetic waves for each revolution of shaft 71*a* and feed roller 17. Each pulse presently has a "width" of 250 nanoseconds. The outer diameter of the feed roller 17 is ten inches. Therefore, sensor 172 produces 60 pulses for each inch of paper which travels over the feed roller 17 toward the chute 19. Primary pulses from sensor 172 are directed 181 to control unit 174 The control unit 174 includes a multiplier 182 which produces ten secondary pulses for each primary pulse 181 received from sensor 172. The multiplier 182 therefore produces 6000 secondary pulses for each 600 primary pulses received 181 from sensor 172. A first counter 300, which will be explained below with respect to FIG. 10, sends a pulse 246 to stepper motor 176 each time the first counter receives a selected number of pulses from the multiplier. Each pulse 246 received by stepper motor 176 causes the stepper motor to rotate through 1.8 degrees of revolution. Rotating the stepper motor through 180 degrees (one half revolution) causes the shafts 23*a* and 23*b* to rotate through a full revolution of 360 degrees. Consequently, when motor 176 receives one hundred pulses, motor 176 rotates through 180 degrees and turns shaft 23 one full revolution. When shaft 23 rotates one full revolution, the chute 19 rotates through a full cycle and dispenses two fold lengths of paper. Pushing button 177 on control unit 174 causes the control unit to send an additional pulse 246 to stepper motor 176. Sending additional pulses to motor 176 advances the folding mechanisms with respect to lines of weakening in the paper being folded. Pushing bottom button 178 causes control unit 174 to omit a pulse 246 which ordinarily would be sent to motor 176 after control unit 174 received a selected number of pulses 181 from sensor 712. Omitting a pulse 246 to motor 176 retards the folding mechanisms with respect to lines of weakening in the strip of paper being folded.

Each time the sensor 46 detects a reference mark on paper strip 87, sensor 46 sends a pulse 245 to a secondary counter 400 in control unit 174. The secondary counter is more fully described below with respect to FIG. 11. The secondary counter, as does the first counter, also receives from the multiplier 182 in the control unit 174 a stream of pulses equivalent to 6000 pulses per inch of paper traveling over the feed roller into the chute 19. Each time the secondary counter receives a pulse 245 from sensor 46 the secondary counter resets itself and begins counting pulses from zero. If the secondary counter receives a pulse 245 from sensor 46 before the secondary counter has received and counted a selected number of pulses from the multiplier 182, then the secondary counter sends an additional or supplemental pulse 246 to the stepper motor because the reference marks are ahead of the paper folding mechanisms. If the secondary counter receives a pulse 245 from sensor 46 after the secondary counter has received and counted a selected number of pulses from the multiplier 182, then the reference marks 173 are behind the paper folding mechanisms and the secondary counter prevents the first counter from sending a pulse 246 to the stepper motor. When the secondary counter 400 deletes a pulse 246 from the pulse train being sent to motor 176 by the first counter, this permits the lines of weakening and reference marks 205 to "catch up" with the folding mechanisms and to regain their synchronized relationship with the folding mechanisms. The reference marks detected by sensor 46 can be lines of weakening, equally spaced marks imprinted along strip 87, etc.

While paper strip 87 passes through the folding apparatus of the invention, the paper strip 87 tends to stretch or, possibly, under certain condition tends to contract. Such stretching or contracting of the paper causes the lines of weakening in the paper to move out of their proper synchronized position with the folding mechanisms as the paper strip 87 moves through the paper folding machine. In particular, when the paper dispensing mouth of chute 19 is in a selected position along its arc of travel, then the line of weakening which is moving in a direction of travel away from the feed roller toward the dispensing mouth of the chute and which is closest to the dispensing mouth of the chute should be a selected distance away from the dispensing mouth of the chute. If, instead, this line of weakening which is closest to the dispensing mouth of the chute is a distance away from the dispensing mouth of the chute which is greater than said selected distance from the chute mouth, then the lines of weakening are out of synchronism with the folding mechanisms of the paper folding machine. If the lines of weakening are out of synchronism by relatively small amounts, say of eighth of an inch or less, the paper folding machine likely will function. If, however, the lines of weakening are out of synchronism by significant amounts, then the maximum operating speed of the folding machine will be less and the tendency for the machine to jam or to not properly fold the strip of paper 87 along its lines of weakening 88 will increase. Sensor 46 and control unit 174, along with stepper motor 176, automatically compensate for the stretching or contraction of paper or for other operational conditions which cause the paper and lines of weakening in the paper to lag behind or run ahead of synchronism with the folding mechanisms of the paper folding machine of the invention.

Figure 10:
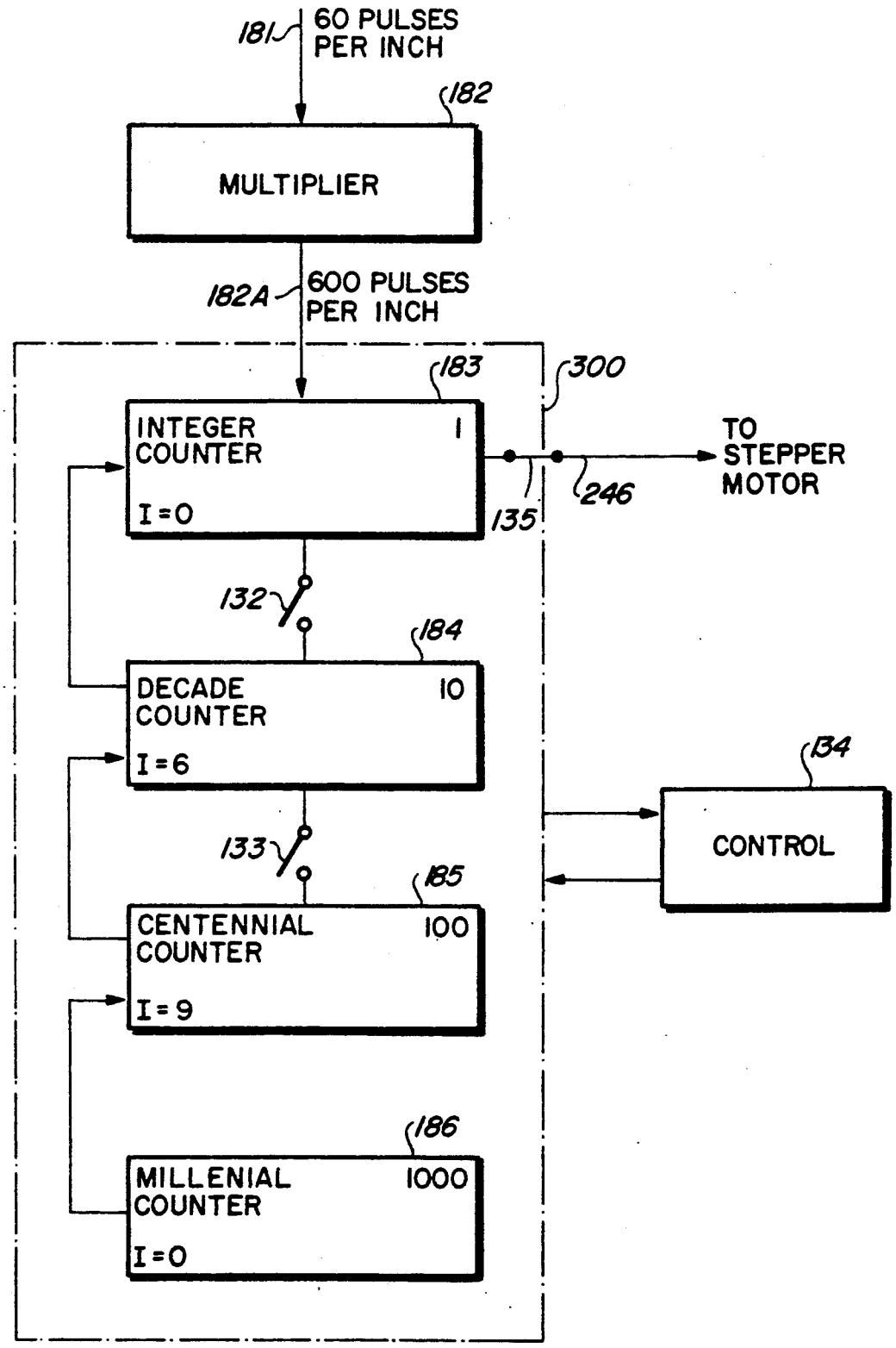
FIG. 10 is a block flow diagram of a counter system utilized in the apparatus of FIG. 6; and, FIG. 11 is a block flow diagram of another counter system utilized in the apparatus of FIG. 6.

FIG. 10 illustrates the first counter in control unit 174. The first counter receives 182A from the multiplier 182 six hundred pulses per inch of paper passing over the feed roller 17. Pulses 182A from the multiplier are received by the integer counter 183 of the first counter 300. Counter 300 also includes decade counter 184, centennial counter 185, and millennial counter 186 At the outset of operation of the paper folding machine, the integer counter 183 is initialized with I=0; the decade counter is initialized with I=6; the centennial counter is initialized with I=9; and, the millennial counter is initialized with I=0. These initialized values cause, as will be seen, the first counter 300 to generate a pulse each time it receives ninety-six pulses from multiplier 182. Each time counter 300 generates a pulse 246 to the stepper motor, counter 300 resets itself to the preliminary initial I values noted above, counts another ninety-six counts, generates a pulse 246 to the stepper motor, resets itself again to the preliminary initial I values, etc. The first counter 300 also includes switches 132, 133, 135 and control 134. The counter 300 is, as noted, initialized to produce a pulse 246 to stepper motor 176 for each ninety-six pulses received from multiplier 182 by counter 300. The ninety-six pulses required to produce a pulse 246 to motor 176 is derived from the fact that the fold length (i.e., the distance between a first folded line of weakening and the next immediately succeeding folded line of weakening) is, in this example, eight inches and that the circumference of the cylindrical feed roller 17 is ten inches. This is better explained with reference to TABLE I below.

TABLE I

CALCULATION OF MULTIPLIER PULSES REQUIRED PER PULSE TO STEPPER MOTOR

| | FOLD LENGTH** (inches) | | |
|---|---|---|---|
| | 4.0 | 8.0 | 16.0 |
| Length of paper through chute during one cycle of chute | 8.0 | 16.0 | 32.0 |
| Encoder pulses produced during one cycle of chute @60 pulses/inch | 480.0 | 960.0 | 1920.0 |
| Multiplier pulses produced during one cycle of chute @600 pulses/inch | 4800.0 | 9600.0 | 19200.0 |
| Number of multiplier pulses required to produce one pulse to stepper motor. One pulse to stepper motor rotates the motor through 180° revolution. ½ revolution of stepper motor rotates power shaft one revolution. | 48 | 96 | 192 |

**1. Circumference of input (feed) roller is ten (10) inches.
2. Rotary encoder produces 600 pulses per revolution of input roller. Rotary encoder produces 60 pulses per inch of paper dispensed by input roller.

As shown above in TABLE I, when the fold length is eight inches, then sixteen inches of paper is distributed during one cycle of the chute. During a cycle, the chute twice approximately swings through its arc of travel. During the time it takes the chute to distribute sixteen inches of paper, sensor 172 will produce nine hundred and sixty pulses to the multiplier 182 in control unit 174. Similarly, during the time it takes the chute to distribute sixteen inches of paper, the multiplier 182 will produce 9600 pulses. Since the chute must pass through one cycle to distribute sixteen inches of paper, stepper motor 176 should rotate shaft 23 one revolution. Rotating shaft 23 one revolution causes the chute 19 to move through one cycle. The stepper motor must rotate one hundred and eighty degrees (one half revolution) to rotate shaft 23 one revolution (360 degrees). One hundred pulses 246 are required to rotate motor 176 through one hundred and eighty degrees. The 9600 pulses per sixteen inches produced by multiplier 182 are divided by the one hundred pulses 246 required to move the motor 176 through one hundred and eighty degrees. 9600 divided by one hundred gives 96 pulses from the multiplier 182 which must be received by the counter 300 in order to generate one pulse 246 to the stepper motor 176. Accordingly, counter 300 is initialized with I=0 in the integer counter, with I=6 in the decade counter, with I=9 in the centennial counter, with I=0 in the millennial counter, and with switches 132, 133 open. In operation of the counter 300, for each of the first six pulses 182A received from multiplier 182, the decade counter unloads an integer count to the counter 183. Once the integer counter 183 counts six pulses, I=0 in the decade counter 184 and switch 132 closes. For each of the next nine sets of ten counts, the centennial counter 185 unloads a set of ten counts to the decade counter 184. After the decade counter 184 has counted ninety pulses, I=0 in the centennial counter 185 and switch 133 closes. At the moment switch 133 closes, I=0 in each counter 183 to 186, counter 183 sends a pulse 246 to the stepper motor 176, and control 134 reinitializes counter 300 so that each counter has the I value shown in FIG. 10. Control 134 also opens switches 132 and 133. Counter 300 then counts another ninety-six pulses, sends a pulse to motor 176, etc. When button 177 on control unit 174 is depressed, switch 135 is opened so that pulses 246 from integer counter 183 are prevented from reaching stepper motor 176. When button 177 is released, then switch 135 is closed. When button 178 on control unit 174 is depressed, integer counter 183 is caused to produce pulses 246 at a rate faster than the rate at which counter 300 counts ninety-six pulses and produces a pulse 246 to the stepper motor 176. When button 178 is released, counter 300 only produces a pulse 246 each time counter 300 receives 96 pulses from multiplier 182.

When control 174 elects to advance chute 19 through a distance equal to about one oscillation during a selected period of time in order to distribute a fold length in a reversed orientation, control 174, during the selected period of time, sends fifty pulses to stepper motor 176 in addition to the pulses that it ordinarily sends to the stepper motor 176 to keep the chute 19 and folding mechanisms in synchronous relation with the feed roller 17 and paper strip 87. The additional fifty pulses rotate shaft 23 through one half revolution. Rotating shaft 23 through one-half revolution moves the chute 19 through a distance equal to about one oscillation. By way of example, if the speed of movement of paper through the folding machine is sixteen inches per second, and control 174 elects to advance the chute 19 through about one oscillation in one-half of a second, then during that one-half second period control 174 transmits 100 pulses to stepper motor 176. The one hundred pulses include fifty pulses which the stepper motor sends to stepper motor 176 to keep the chute 19 and folding mechanisms in sync with feed roller 17 and also includes an additional fifty pulses which advance chute 19 through about one oscillation with respect to feed roller 17.

Figure 11:
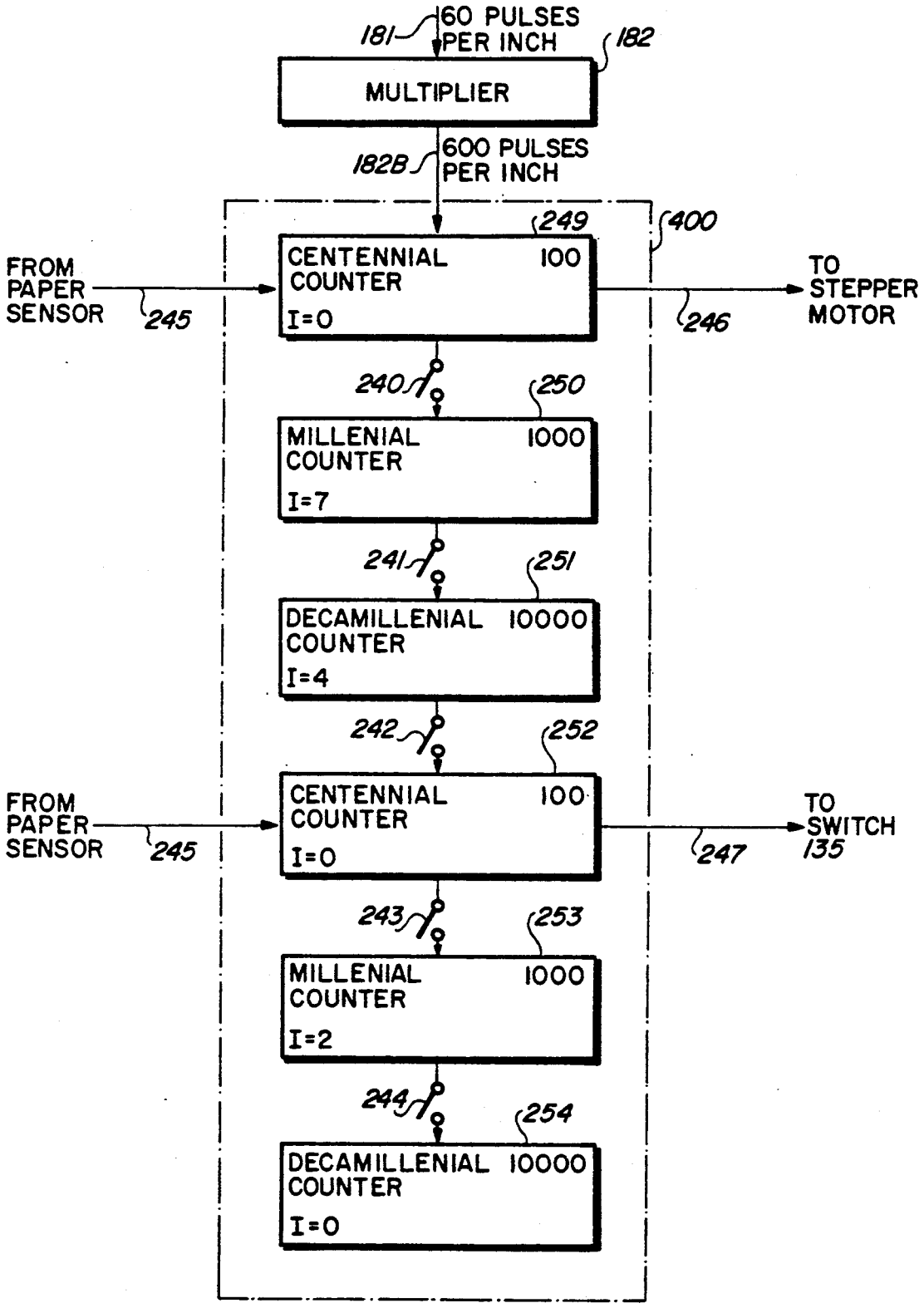

FIG. 11 illustrates the second counter in control unit 174. The second counter is utilized to automatically compensate for when the lines of weakening passing through the paper folding machine lag behind or run ahead of the desired synchronization of the lines of weakening with paper folding mechanisms in the machine. The second counter 400, as does the first counter 300, receives 182B from multiplier 182 six hundred pulses per inch of paper passing over the feed roller 17. Each pulse 182B from multiplier 182 is received by centennial counter 249. At the outset of operation of the paper folding machine, centennial counter 249 is initialized at zero; millennial counter 250 is initialized at I=7; decamillennial counter 251 is initialized at I=4; centennial counter 252 is initialized at I=0; millennial counter 253 is initialized at I=2; and decamillennial counter is initialized at I=0. Switches 240 to 244 are open. In FIG. 11, it is assumed that the control unit for counter 400 is included in the centennial counter 249. Second counter 400 also includes switches 240, 241, 242, 243, and 244. Counters 249 to 251 are initialized to count to 4700. Counters 252 to 254 are initialized to count to two hundred.

In FIG. 5, the distance between each pair of 205A–205B, –205B–205C of reference marks is, for sake of this example, assumed to be eight inches. Consequently, multiplier 182 normally produces 4800 pulses when the paper strip 87 moves from a position with one reference mark 205B under stationary sensor 46 to another position with the next successive reference mark 205B underneath sensor 46. The counter 400 in FIG. 11 is set up so that if counter 400 receives fewer than 4701 pulses from multiplier 182 before it receives a pulse 245 from sensor 46 then counter 249 sends a supplemental or additional pulse 246 to the stepper motor 176 to advance the folding mechanisms with respect to the paper. If the counter 400 in FIG. 11 receives more than 4900 pulses from multiplier 182 before counter 400 receives a pulse 245 from sensor 46, then counter 252 causes switch 135 to open to prevent a pulse 246 produced by counter 183 from reaching stepper motor 176. After switch 135 has been open a period of time to insure that at least one pulse 246 has been prevented from reaching motor 176, then counter 252 closes switch 135 so that subsequent pulses 246 produced by counter 183 will continue to reach motor 176. More specifically, in operation of the counter 400, for each of the first seven sets of one hundred counts, the millennial counter 250 downloads a set of one hundred counts to the centennial counter. When all seven sets of one hundred counts have been downloaded to the centennial counter and counter 249 has received seven hundred pulses, I=0 in the millennial counter and switch 240 closes. For each of the next four sets of one thousand counts received by the decamillennial counter 251, the decamillennial counter 251 downloads a set of one thousand counts to the millennial counter. When all four sets of one thousand counts have been downloaded to the millennial counter and counter 250 has received four thousand pulses, I=0 in the decamillennial counter and switch 242 closes. If prior to the closing of switch 242 counter 249 receives a pulse 245 from sensor 46, then counter 249 sends a supplemental pulse 246 to motor 176 and counters 250 and 251 are reinitialized with I=7 and I=4, respectively, and switches 240 and 241 are opened. If prior to the closing of switch 242 counter 249 has not received a pulse 245 from sensor 46, then counter 252 continues counting pulses 182B from multiplier 182. For each of the next two sets of one hundred counts, the millennial counter 253 unloads a set of one hundred counts to the centennial counter 252. After counter 252 has counted two hundred pulses, I=0 for counter 253 and switch 244 closes. If after switch 242 closes and prior to switch 244 closing counter 252 receives a pulse 245 from sensor 46, then all counters 249 to 254 in second counter 400 are reinitialized to the values shown in FIG. 11, any closed switches 240 to 243 are opened, and no supplemental pulse 246 is sent to motor 176. If no pulse 245 has been received by counter 252 prior to the closing of switch 244, then after switch 244 closes counter 252 causes switch 135 to open for a period of time sufficient to prevent at least one pulse produced by counter 183 from reaching stepper motor 176. Consequently, first counter 300, second counter 400, control unit 174, and motor 176 work in tandem to maintain the folding mechanisms in synchronization with the feed roller 17 and to maintain the lines of weakening in the paper strip 87 in synchronization with the folding mechanisms. After switch 244 closes, all counters 249 to 254 are reinitialized to the values shown in FIG. 11 and switches 240 to 244 are opened. Centennial counter 249 again begins counting and the counting cycle by counter 400 is repeated in the manner just described.

The number of pulses counted by counter 400 to advance, retard, or maintain the synchronism of the folding mechanisms with respect to the lines of weakening in the paper can vary as desired. For example, in counter 400 the initialized values of counters 249 to 254 could be I=0, I=6, I=4, I=0, I=1, I=0, respectively.

The number of pulses counted by counter 300 prior to sending a pulse 246 to motor 176 varies depending on the diameter of the feed roller 17 and the fold length. For example, if in TABLE I above the fold length is four inches, in counter 300 counters 183 to 186 are initialized with I=0, I=8, I=4, and I=0, respectively, so that a pulse 246 is produced for each forty eight pulses 182A received from multiplier 182.

Control unit 174 includes means for programming counters 183 to 186 and 249 to 254 to desired initialization values. In one embodiment of the invention, such programming means includes a keyboard for inputting into control unit 174 the fold length and diameter of the feed roller. Internal circuitry and/or software determines the proper initialization or I values for counters 183 to 186 and sets the counters 183 to 186 to the proper I values. Similarly, the keyboard is utilized to input the distance between reference points 205A–205B so that internal circuitry and/or software determines the proper I values for and sets counters 249 to 254.

Control unit 174 can also include means for programming unit 174 to command motor 176 to advance chute 19 through a selected distance, say one oscillation, with respect to feed roller 17 when a report or "job" with an odd number of pages is next to be folded. The control unit 174 would command motor 176 to advance the chute within a selected period of time in relation to the velocity of the strip of paper 87 so that the chute 19 would reach its desired position before the leading cut edge 88A of the first sheet of paper in the report was distributed by the chute 19 into the folding mechanisms.

Figure 7:
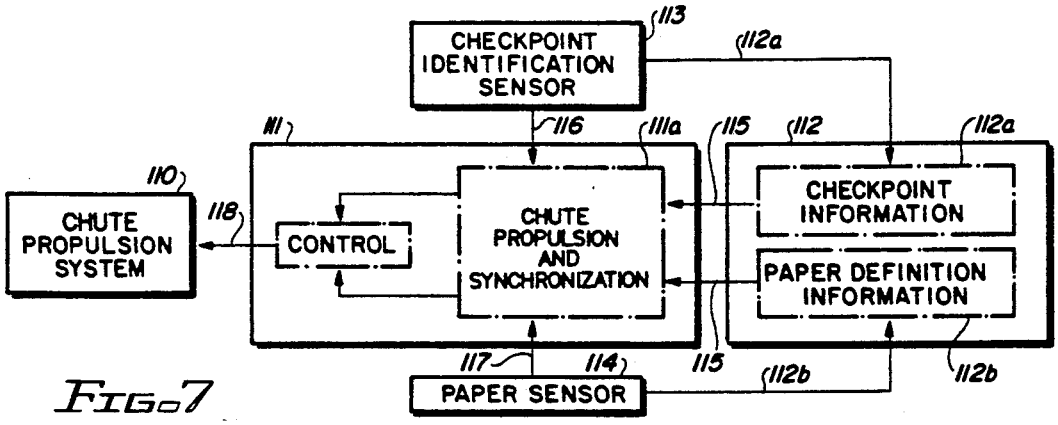
FIG. 7 is a block diagram illustrating an improved chute advancement system embodying the present invention.
Figure 8:
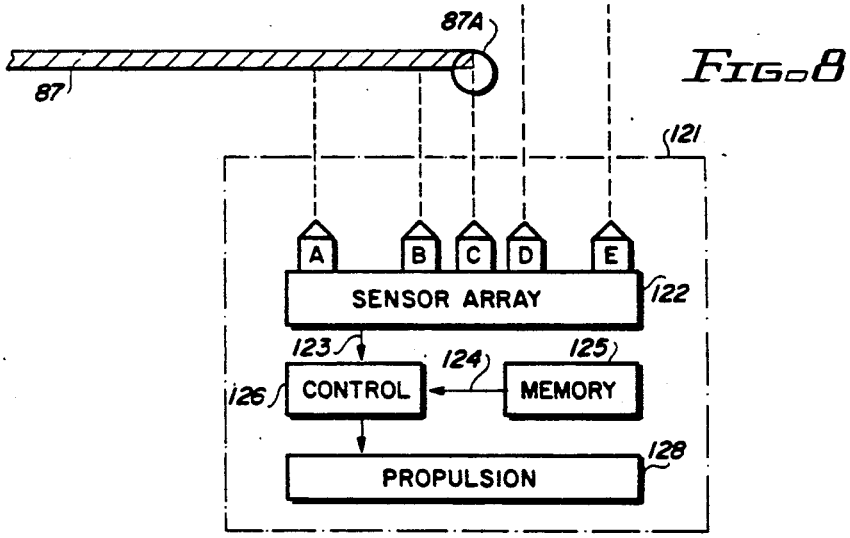
FIG. 8 illustrates a paper checkpoint sensor which is employed in the embodiment of the invention in FIG. 7.
Figure 9:
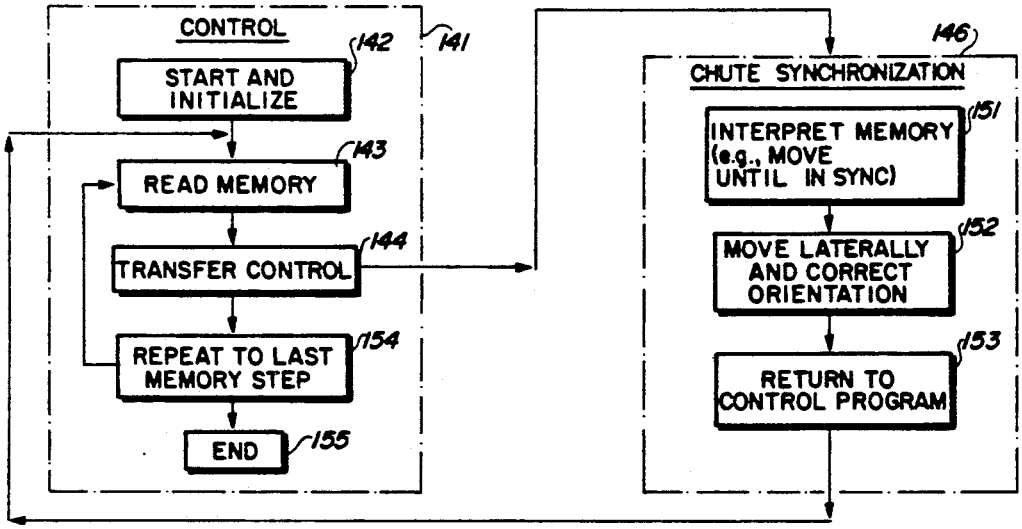
FIG. 9 is a block flow diagram which illustrates a typical program or logic function utilized in accordance with the embodiment of the invention in FIG. 7.

An automated embodiment of the invention is illustrated in FIGS. 7 to 9. FIG. 7 is a block diagram which illustrates a preferred embodiment of an improved chute guidance system of the invention, the main components of which are a chute propulsion system 110, a propulsion system controller 111, and a memory 112. A checkpoint identification sensor 113 and a paper sensor 114 are provided. The checkpoint identification sensor 113 includes a sensor 46 to detect reference points along paper strip 87 with respect to the folding mechanisms. For example, the sensor 113 could detect lines of weakening 88 or reference marks 205 imprinted on paper strip 87 in FIG. 5. The normal distance between each mark 205 or line 88 is known. Sensor 113 indicates when each mark 205 passes by sensor 113. In this description of the system of FIGS. 7, 8, and 9, it is assumed that apparatus equivalent to that of FIG. 6 is being utilized. As used herein, the distance between a pair of reference marks 205 refers to the shortest distance between a successive pair of reference marks, such reference marks normally being equally spaced along paper strip 87 and lying along a line parallel to the direction of travel of strip 87 through the paper folding apparatus.

Checkpoint identification sensor 113 also includes a sensor 175 to provide information concerning the number of pages or other data concerning a report which is to be cut, folded, and separated from strip 87. Sensor 175 can read a reference area 173 to determine the number of pages in a report or can determine the number of pages in a report by any other desired means.

Paper sensor 114 is equivalent to sensor 172 and generates signals indicating the speed at which paper strip 87 is input into the spirals and other folding mechanisms.

The memory 112 contains both checkpoint identification information 11*a* and paper definition information 112*b*. The sensor 114 used to provide paper definition information can comprise a sensor 172, can comprise a keyboard which an operator uses to periodically input paper input speed, or can be any other suitable sensor data input system.

After the checkpoint information 112*a* and paper definition information 112*b* are stored in the memory 112, during subsequent operation cycles this information can be recalled from memory 112 and the recalled information 115 is fed to the controller 111, and used in the chute synchronization sub-routine 146 to determine the proper operation of the chute and other folding mechanism with respect to the speed of the paper. Information from sensors 114, 113 is also directly fed 117, 116 to controller 111. The controller 111 generates control signals 118 which are fed to chute propulsion system 110. System 110 includes stepper motor 176 and provides the motive power to drive the spirals 42, chute 19, and beaters 41. The spiral propulsion system 110 also includes shaft 23 (including segments 23*a* and 23*b*) and the other gear train components transmitting motive power from motor 176 to the chute 19 and other folding mechanisms.

The chute propulsion system 110 can be any suitable system for providing motive power to the folding mechanisms in response to signals from control unit 174.

The memory 12 can be any suitable prior art memory unit such as are commonly used in industrial machines, numerical control machines, etc. For example, electromagnetic memories such as magnetic, optical, solid state, etc. or mechanical memories such as paper tape can be used.

Sensor array 122 can comprise a single sensor 46 as illustrated in FIG. 4. When sensor array 122 is utilized to locate a reference point such as mark 205, array 122 can comprise a plurality of sensors A–E and be mounted at a fixed location on or adjacent the apparatus of FIGS. 4 to 6.

The sensor array 122 can be a series of mechanically operated switches, ultrasound range detectors or any other suitable sensor which detects the proximity of a selected reference point moving by the sensor array. In FIG. 5 each reference mark 205 and the line of perforation 88 comprise reference points or checkpoints.

FIG. 9 is a block flow diagram which illustrates a typical program or logic function which is executed by the controller 111 for operating the chute 19 and other folding mechanisms in synchronization with the feed roller 17 and for compensating for the stretching or contraction of the paper strip 87 as it passes through the folding machine. The basic control program 141 consists of commands to "start and initialize" 142, "read memory" 143 and "transfer control" 144 to the chute synchronization sub-routine 146. The chute synchronization sub-routine 146 consists of commands to "interpret memory" 151 (i.e., determine the adjustment of the stepper motor necessary to maintain synchronization with feed roller or paper) and "advance, retard or maintain" 152 the chute (i.e., apply motive power to chute to advance, retard or maintain synchronization with feed roller and paper). Command 152 is followed by "return to control program" 153. The chute synchronization sub-routine 146 is repeated as indicated by the "repeat to last memory step" 154 of the control program 141 followed by an "end" program 155 which completes the execution of the program.

In use, paper strip 87 is fed into the spiral paper folding machine of FIGS. 4 to 6 by roller 17. Sensor 172 generates pulses 181 to control unit 174. Each time unit 174 receives a selected number of pulses, it generates a pulse 246 to stepper motor 176. The pulses 246 to stepper motor 176 cause motor 176 to power the folding mechanisms in synchronization with roller 17. Pulses 245 generated by sensor 46 indicate when strip 87 is stretched or contracted and cause control unit 174 to advance or retard motor 176 to synchronize the folding mechanisms with lines of weakening in strip 87. Sensor 175 signals control unit 174 when a new "job" or report is ready to pass between rollers 200 and 201. Control unit 174 commands roller 200 to momentarily retard so the leading edge 88A of the report is partially cut by blade 202. After the leading edge 88A of the report is partially cut, control unit 174 commands rollers 500 and 510 to temporarily increase their speed of rotation to completely sever leading edge 88A from trailing edge 88B in the chute 19. If there are an odd number of pages in the report, control unit 174 then, after leading edge 88A of the report is completely severed from trailing edge 88B, commands stepper motor 176 to temporarily increase the speed of rotation of shaft 23 so that chute 19 is advanced through about one oscillation with respect to rollers 17 and 92 before the leading edge 88A of the report is dispensed by chute 19. As soon as chute 19 is advanced through one oscillation, then motor 176 resumes the normal rotation of shaft 23 necessary to maintain the synchronous operation of the chute, spirals, beaters, and feed rollers 17, 92.

Stepper motor 176 or any other desired means for advancing chute 19 through a distance equal to about one oscillation of chute 19 can be positioned at any desired position on the folding apparatus constructed in accordance with the invention. For example, a second stepper motor could be attached to the shaft 41 of the differential of the apparatus illustrated in FIGS. 1 and 2. This stepper could be utilized to advance and retard chute 19 and the folding mechanisms by small amounts and could also be utilized to advance the chute 19 through one oscillation with respect to the feed rollers 17 and 92. The stepper motor attached to shaft 41 could be utilized in conjunction with motor 176 or could be utilized on the folding machine of FIGS. 1 to 5 when gears 78 to 81 were used to power shaft 23 instead of motor 176.

Having described my invention in such terms as to enable those skilled in the art to understand and practice it, and having identified the presently preferred embodiments thereof, I claim:

1. In combination with apparatus for producing continuous form stationery by folding a strip of paper along transverse lines of weakening formed therein while said strip of paper moves along a path of travel through said apparatus, said strip of paper having front and back surfaces, said apparatus including a frame, oscillating guide means mounted on said frame for alternately distributing successive ones of said lines of weakening in said strip of paper in substantially opposite directions, dispensing means for feeding said strip as paper into said guide means at a predetermined velocity, folding means carried on said frame and operatively associated with said oscillating guide means for urging said strip of paper distributed by said guide means into a zig-zag stack comprised of fold lengths of said strip of paper, each fold length normally being connected to at least one other fold length of said strip of paper along one of said transverse lines of weakening, said folding means normally receiving and folding one of said lines of weakening each time said guide means moves through one oscillation, gear train means for transmitting motive power to actuate said oscillating guide means and said folding means, a drive shaft for transmitting motive power to said gear train means actuating said oscillating guide means and folding means, said drive shaft rotating at a first normal speed of rotation with respect to said velocity of said strip of paper, means for transmitting motive power to said dispensing means, power means to drive said means for transmitting motive power to said dispensing means, said guide means, dispensing means and folding means normally moving in synchronous relationship during the operation of said apparatus, the improvement comprising means for advancing said guide means through about one oscillation with respect to said strip of paper, said advancing means including (a) cutting means for partially severing said strip of paper along a selected transverse lineation;

(b) tensioning means mounted on said guide means to tension said strip of paper moving through said oscillating guide means to cause said strip of paper to pull apart and completely sever along said selected transverse lineation partially severed by said cutting means to form a pair of opposing cut edges, said pair of edges including (i) a trailing cut edge, and (ii) a leading cut edge next distributed by said guide means after said guide means distributes said trailing edge;

(c) sensor means for determining when said selected transverse lineation is severed to form said cut edges and for generating paper timing signals representing the severing of said selected transverse lineation;

(d) motor means connected to said drive shaft and responsive to said paper timing signals to (i) before said leading cut edge is dispensed by said guide means and received by said folding means, temporarily increase with respect to said velocity of said strip of paper the speed of rotation of said drive shaft from said first normal speed of rotation to a second speed of rotation, and (ii) decrease said speed of rotation of said drive shaft from said temporary second speed of rotation back to said first normal speed of rotation after said drive shaft has rotated at said second speed of rotation for a selected period of time;

the rotation of said drive shaft at said second speed of rotation for said selected period of time advancing said guide means through about one oscillation with respect to said strip of paper such that said front surface on the fold length of said strip of paper including said leading cut edge faces in the same direction as said front surface on the fold length of said strip of paper including said trailing cut edge.

2. In combination with apparatus for producing continuous form stationery by folding a strip of paper along transverse lines of weakening formed therein while said strip of paper moves along a path of travel through said apparatus, said strip of paper having front and back surfaces, said apparatus including a frame, oscillating guide means mounted on said frame for alternately distributing successive ones of said lines of weakening in said strip of paper in substantially opposite directions, dispensing means for feeding said strip of paper into said guide means at a predetermined velocity, folding means carried on said frame and operatively associated with said oscillating guide means for urging said strip of paper distributed by said guide means into a zig-zag stack comprised of fold lengths of said strip of paper, each fold length normally being connected to at least one other fold length of said strip of paper along one of said transverse lines of weakening, said folding means normally receiving and folding one of said lines of weakening each time said guide means moves through one oscillation, gear train means for transmitting motive power to actuate said oscillating guide means and said folding means, a drive shaft for transmitting motive power to said gear train means actuating said oscillating guide means and folding means, said drive shaft rotating at a first normal speed of rotation with respect to said velocity of said strip of paper, means for transmitting motive power to said dispensing means, power means to drive said means for transmitting motive power to said dispensing means, said guide means, dispensing means and folding means normally moving in synchronous relationship during the operation of said apparatus, the improvement comprising means for advancing said guide means through about one oscillation with respect to said strip of paper, said advancing means including (a) means for, before a selected transverse lineation on said strip is dispensed by said guide means and received by said folding means, completely severing said strip of paper along said selected transverse lineation to form a pair of opposing cut edges, said pair including (i) a trailing cut edge, and (ii) a leading cut edge next distributed by said guide means after said guide means distributes said trailing edge;

(b) sensor means for determining when said selected transverse lineation is severed to form said cut edges and for generating paper timing signals representing the severing of said selected transverse lineation;

(c) motor means connected to said drive shaft and responsive to said paper timing signals to (i) before said leading cut edge is dispensed by said guide means and received by said folding means, temporarily increase with respect to said velocity of said strip of paper the speed of rotation of said drive shaft from said first normal speed of rotation to a second speed of rotation, and (ii) decrease said speed of rotation of said drive shaft from said temporary second speed of rotation back to said first normal speed of rotation after said drive shaft has rotated at said second speed of rotation for a selected period of time;

the rotation of said drive shaft at said second speed of rotation for said selected period of time advancing said guide means through about one oscillation with respect to said strip of paper such that said front surface on the fold length of said strip of paper including said leading cut edge faces in the same direction as said front surface on the fold length of said strip of paper including said trailing cut edge.

3. In combination with apparatus for producing continuous form stationery by folding a strip of paper along transverse lines of weakening formed therein while said strip of paper moves along a path of travel through said apparatus, said strip of paper having front and back surfaces, said apparatus including a frame, oscillating guide means mounted on said frame for alternately distributing successive ones of said lines of weakening in said strip of paper in substantially opposite directions, dispensing means for feeding said strip of paper into said guide means at a predetermined velocity, folding means carried on said frame and operatively associated with said oscillating guide means for urging said strip of paper distributed by said guide means into a zig-zag stack comprised of fold lengths of said strip of paper, said folding means normally receiving and folding one of said lines of weakening each time said guide means moves through one oscillation, gear train means for transmitting motive power to actuate said oscillating guide means and said folding means, a drive shaft for transmitting motive power to said gear train means actuating said oscillating guide means and folding means, said drive shaft rotating at a first normal speed of rotation with respect to said velocity of said strip of paper, means for transmitting motive power to said dispensing means, power means to drive said means for transmitting motive power to said dispensing means, said guide means, dispensing means and folding means normally moving in synchronous relationship during the operation of said apparatus, the improvement comprising means for, before a selected transverse lineation on said strip of paper is dispensed by said guide means and received by said folding means, (a) completely severing said strip of paper along said selected transverse lineation to form a pair of opposing cut edges, said pair including (i) a trailing cut edge, and (ii) a leading cut edge next distributed by said guide means after said guide means distributes said trailing edge;

(b) temporarily increasing with respect to said velocity of said strip of paper the speed of rotation of said drive shaft from said first normal speed of rotation to a second speed of rotation; and (c) decreasing said speed of rotation of said drive shaft from said temporary second speed of rotation back to said first normal speed of rotation after said drive shaft has rotated at said second speed of rotation for a selected period of time;

the rotation of said drive shaft for said selected period of time at said second speed of rotation advancing said guide means through about one oscillation with respect to said strip of paper such that said front surface on the fold length of said strip of paper including said leading cut edge faces in the same direction as said front surface on the fold length of said strip of paper including said trailing cut edge.

4. The combination of claim 1 wherein said tensioning means intermittently increases said tension on said strip of paper to cause said strip of paper to pull apart and completely sever along said selected transverse lineation partially severed by said cutting means.

5. The combination of claim 1 wherein said selected transverse lineation is one of said lines of weakening.

6. The combination of claim 2 wherein said selected transverse lineation is one of said lines of weakening.

7. The combination of claim 3 wherein said selected transverse lineation is one of said lines of weakening.

* * * * *